US009670040B2

(12) United States Patent
Martinez Martinez

(10) Patent No.: US 9,670,040 B2
(45) Date of Patent: Jun. 6, 2017

(54) BOTTLE JACK

(71) Applicant: Melchor Gabilondo, S.A., Berriz (Vizcaya) (ES)

(72) Inventor: Antonio Martinez Martinez, Berriz (ES)

(73) Assignee: Melchor Gabilondo, S.A., Berriz (Vizcaya) (ES)

( * ) Notice: Subject to any disclaimer, the term of this patent is extended or adjusted under 35 U.S.C. 154(b) by 0 days.

(21) Appl. No.: 14/892,565

(22) PCT Filed: May 20, 2014

(86) PCT No.: PCT/ES2014/070413
§ 371 (c)(1),
(2) Date: Nov. 19, 2015

(87) PCT Pub. No.: WO2014/188039
PCT Pub. Date: Nov. 27, 2014

(65) Prior Publication Data

US 2016/0122164 A1 May 5, 2016

(30) Foreign Application Priority Data

May 20, 2013 (ES) ..... 201300459 U
May 20, 2013 (ES) ..... 201300464 U

(51) Int. Cl.
*B66F 3/42* (2006.01)
*B66F 3/25* (2006.01)

(52) U.S. Cl.
CPC . *B66F 3/42* (2013.01); *B66F 3/25* (2013.01)

(58) Field of Classification Search
CPC ..... B66F 3/42; B66F 3/24
See application file for complete search history.

(56) References Cited

U.S. PATENT DOCUMENTS 1,763,404 A 6/1930 McBride
1,964,003 A 6/1934 McBride
(Continued)

FOREIGN PATENT DOCUMENTS

EP 1468956 10/2004
EP 1700816 9/2006
(Continued)

OTHER PUBLICATIONS

International Preliminary Report on Patentability for PCT/ES2014/070413, mailed Aug. 26, 2015.
(Continued)

*Primary Examiner* — Joseph J Hail
*Assistant Examiner* — Joel Crandall
(74) *Attorney, Agent, or Firm* — Klarquist Sparkman, LLP

(57) ABSTRACT

The present invention relates to a bottle jack comprising a main body and a shaft that expands or contracts, further comprising:

- a passage space communicating a hydraulically operated circuit with an unloading circuit through which the controlled outlet of hydraulic fluid from the hydraulically operated circuit and subsequent lowering of the shaft occur;
- a closure element elastically pushed towards the passage space to prevent the outlet of hydraulic fluid therethrough;
- a ram assembly elastically pushed in the longitudinal backward movement direction (B) with a force greater than the force with which the closure element is elastically pushed against the passage space; and
- a telescopic lever assembly which can be lowered by a user to operate the hydraulically operated system.

11 Claims, 6 Drawing Sheets

(56) References Cited

U.S. PATENT DOCUMENTS

| | | | | | |
|---|---|---|---|---|---|
| 2,398,558 | A | | 4/1946 | Reimuller | |
| 2,539,739 | A | * | 1/1951 | Grime | B66F 3/42 60/425 |
| 2,550,163 | A | * | 4/1951 | Phenning | B66F 3/42 254/93 H |
| 2,618,122 | A | * | 11/1952 | Gratzmuller | B66F 3/28 277/438 |
| 4,330,104 | A | * | 5/1982 | Klok | B66F 3/24 254/93 A |
| 8,550,434 | B1 | * | 10/2013 | Hanlon | B66F 3/25 254/30 |
| 2012/0125144 | A1 | * | 5/2012 | Law | B66F 3/25 74/544 |

FOREIGN PATENT DOCUMENTS

| | | | | | |
|---|---|---|---|---|---|
| GB | 171234 | A | * | 11/1921 | B66F 3/42 |
| GB | 410048 | A | * | 5/1934 | B66F 3/42 |
| GB | 940744 | A | * | 10/1963 | B66F 3/42 |
| GB | 1233482 | | | 5/1971 | |

OTHER PUBLICATIONS

International Search Report for PCT/ES2014/070413, mailed Aug. 20, 2014.
Written Opinion for PCT/ES2014/070413, mailed Aug. 20, 2014.
Extended Search Report for corresponding EP-14800677.8 (mailed Dec. 19, 2016).

* cited by examiner

BOTTLE JACK

CROSS REFERENCE TO RELATED APPLICATIONS

This is the U.S. National Stage of International Application No. PCT/ES2014/070413, filed May 20, 2014, which in turn claims the benefit of and priority to Spanish Application Nos. U201300459, filed May 20, 2013 and U201300464, filed May 20, 2013.

FIELD OF THE ART

The invention relates to a bottle jack of the type formed by a main body and a hydraulically operated shaft expanding or contracting with respect to the main body for lifting and lowering a load.

STATE OF THE ART

A bottle jack is an apparatus which allows lifting very heavy objects and is basically formed by a generally cylindrical main body with a hydraulically operated shaft projecting from the inside thereof. The shaft is capable of moving up and down when hydraulic operation is activated by a user, which allows lifting or lowering a heavy object. The name "bottle" comes from the fact that a significant portion of the main body usually has a shape resembling a bottle.

To allow lifting the heavy object, the bottle jack comprises an operating mechanism on which the user can act. Said operating mechanism is generally a lever connected in an articulated manner to the rest of the jack. When the user pushes the lever and causes rotation thereof with respect to the rest of the jack, specific operating mechanisms comprised in the jack convert mechanical energy acquired by the lever into pressure of a hydraulic fluid contained in an inner operating circuit of the jack. The pressure acquired by the hydraulic fluid then causes movement of the shaft and lifting thereof with respect to the main body. As it moves up, the shaft pushes the heavy object upward, causing it to be lifted.

The bottle jack must also allow lowering the load or object being lifted by the jack. The jack must assure that the object is lowered in a controlled manner without causing the object to lose balance, fall or overturn, all of which are extremely dangerous for the jack user and which can cause damage to the object held by the jack. To allow controlled lowering, bottle jacks usually comprise an unloading system which, when operated by the user, opens the hydraulically operated circuit in a controlled manner, allowing the weight of the loaded object to gradually cause the shaft to be slowly lowered. To allow said opening of the hydraulically operated circuit, the unloading system comprises a valve which can be operated by means of an outer rotating key, such that when the user rotates the outer rotating key the valve opens slightly, allowing the controlled outlet of hydraulic fluid from the inner operating circuit.

The objective of the present invention is to provide an unloading system for bottle jacks that is an alternative to known systems and offers simple and effective operation as an alternative to operation using a valve with a rotating key.

The unloading system also seeks to provide greater safety for the user and for the load supported by the jack. Specifically, it seeks to find a deadman-type unloading system which stops unloading if the user stops performing the unloading operation.

On the other hand, the lever of a bottle jack can generally be disconnected from the main body, such that a user who wants to store the jack detaches the lever from the main body and stores both securely, supposedly optimizing the space required for storing the jack. One drawback of this way of storing the jack is that the lever tends to get lost.

To solve this problem, another objective of the present invention is to facilitate storing the bottle jack by eliminating or reducing the risk of the lever getting lost.

BRIEF DESCRIPTION OF THE INVENTION

The object of the invention is a bottle jack comprising a main body and a shaft expanding or contracting with respect to the main body for lifting and lowering a load. The shaft expands with respect to the main body due to pressure exerted on the shaft by a hydraulic fluid contained in a hydraulically operated circuit. For example, the main body can be a base on which there is arranged a bottle with the shaft expanding from the inside thereof; in this example, the hydraulically operated circuit allows, in this case, a hydraulic fluid to be moved from a first inner chamber of the bottle, acquiring pressure, to another inner area or chamber of the bottle arranged below the shaft, causing the shaft to move up due to the pressure of the hydraulic fluid. The jack according to the invention has a particular unloading system to allow the controlled outlet of hydraulic fluid from the hydraulically operated circuit (said outflowing fluid being directed towards the first inner chamber of the bottle, for example) so that pressure decreases and the controlled lowering of the shaft and the load supported by the shaft occurs.

Specifically, the bottle jack according to the invention comprises a passage space communicating the hydraulically operated circuit with an unloading circuit through which the controlled outlet of hydraulic fluid from the hydraulically operated circuit and subsequent lowering of the shaft can occur. The jack further comprises a closure element located in the hydraulically operated circuit and elastically pushed towards the passage space to close said passage space and prevent the controlled outlet of hydraulic fluid through the passage space. A ram assembly provided with an outer end outside the unloading circuit and an inner end inside the unloading circuit is further included. The ram assembly is movable with respect to the passage space in a longitudinal forward movement direction towards the passage space and in a longitudinal backward movement direction opposite the longitudinal forward movement direction. The inner end of the ram assembly has the function of pushing the closure element and separating said closure element from the passage space when the outer end is pushed enough to move the ram assembly a sufficient distance in the longitudinal forward movement direction. The jack also comprises a lever assembly which can be lowered by a user to operate the hydraulically operated system, where said lever assembly is telescopic and the total length of the lever assembly is variable.

Additionally, the ram assembly is elastically pushed in the longitudinal backward movement direction with a force greater than the force with which the closure element is elastically pushed against the passage space. Therefore, if the outer end is not pushed in the longitudinal forward movement direction, the ram assembly is always separated from the closure element. As a result, if pushing undesirably or desirably stops during controlled unloading (operated by pushing the outer end in the longitudinal forward movement direction), the ram assembly is automatically separated from the closure element, so unloading stops automatically and immediately. This mechanism increases safety for the jack user and for the load supported by same since it prevents uncontrolled or unwanted lowering of the load, unloading only being possible if it is being deliberately operated (if the outer end of the ram assembly is being deliberately pushed).

According to a preferred embodiment of the invention, the bottle jack comprises a main body and a shaft expanding or contracting with respect to the main body for lifting and lowering a load, where the shaft expands due to pressure exerted by a hydraulic fluid contained in a hydraulically operated circuit. The bottle jack further comprises a passage space communicating the hydraulically operated circuit with an unloading circuit through which the controlled outlet of hydraulic fluid from the hydraulically operated circuit and subsequent lowering of the shaft can occur; a closure element located in the hydraulically operated circuit and elastically pushed towards the passage space to close said passage space and prevent the controlled outlet of hydraulic fluid through the passage space; a ram assembly provided with an outer end outside the unloading circuit, and an inner end inside the unloading circuit, said ram assembly being movable with respect to the passage space in a longitudinal forward movement direction (A) towards the passage space and in a longitudinal backward movement direction (B) opposite the longitudinal forward movement direction (A), where the inner end of the ram assembly pushes the closure element and separates said closure element from the passage space when the outer end is pushed, moving the ram assembly a sufficient distance in the longitudinal forward movement direction (A); where the ram assembly is elastically pushed in the longitudinal backward movement direction (B) with a force greater than the force with which the closure element is elastically pushed against the passage space.

The closure element is preferably a ball.

The closure element is preferably elastically pushed towards the passage space by a spring.

The ram assembly is preferably elastically pushed in the longitudinal backward movement direction (B) by a spring.

The user can preferably operate the outer end of the ram assembly from outside the main body in the longitudinal forward movement direction (A).

The bottle jack preferably comprises an operating lever for pushing the outer element in the longitudinal forward movement direction (A). The operating lever can also preferably be assembled on a receiving element articulated to the main body to allow applying pressure on the hydraulic fluid contained in a hydraulically operated circuit and expansively operating the shaft.

The bottle jack preferably comprises an L-shaped part arranged in an inverted manner against a base of the main body, where said L-shaped part comprises an upper segment and a side segment and is capable of rotating with respect to said base according to a rotating shaft, where the side segment pushes the outer end of the ram assembly when the L-shaped part is rotated towards the inner end.

The operating lever can preferably be assembled on the L-shaped part such that rotation of the operating lever causes rotation of the L-shaped part with respect to the rotating shaft. Preferably, said operating lever comprises a notch at one end defining a hook, and the L-shaped part comprises a protuberance configured for being coupled in the notch and retained by the hook.

According to another preferred embodiment of the invention, the bottle jack comprises a main body and a shaft capable of being moved with respect to the main body in a direction of expansion and in a direction of compression for lifting and lowering a load, respectively. To cause movement of the shaft, the jack comprises a hydraulically operated system which is capable of providing pressure to an inner hydraulic fluid, said pressure finally acting on the shaft to cause movement thereof in the direction of expansion. The jack is further provided with a lever assembly which can be lowered by a user to operate the hydraulically operated system, i.e., to cause an increase in hydraulic fluid pressure. The jack according to one embodiment of the invention furthermore has the particularity that the lever assembly is telescopic and the total length of the lever assembly is variable. Having a telescopic lever assembly the length of which is variable allows the lever assembly to adopt different lengths depending on usage needs. Furthermore, it facilitates being able to stow away the lever assembly to a position of minimal length when the jack is to be stored, optimizing the space required for storing the jack.

In another preferred embodiment, the bottle jack comprises a receiving opening in which a hook-type element comprised in the lever assembly can be engaged. This allows the telescopically stowed lever assembly to be stored hanging from the main body and therefore together with it, the jack being stored as a single integral unit. The risk of the lever assembly getting lost when the jack is not being used is therefore reduced or eliminated in its entirety.

The lever assembly is preferably connected to an articulated receiver providing the lever assembly with a rotating connection with respect to the main body, and the lever assembly can be disassembled from said articulated receiver.

The bottle jack preferably comprises at least one fixing element for fixing the lever assembly, when it is disconnected from the articulated receiver, to an area of the main body other than the articulated receiver. Said fixing element preferably comprises a hook-type element and a receiving opening suitable for receiving said hook-type element.

The fixing element preferably fixes the lever assembly, when it is disconnected from the articulated receiver, to an upper area of the bottle through which the shaft projects. The upper area preferably comprises a neck with a ring rotatably arranged around it, and the fixing element connects the lever assembly, when it is disconnected from the articulated receiver, to said ring. The ring also preferably comprises a handle to allow gripping by the user.

The main body of the bottle jack preferably comprises a base for supporting the jack on the ground or a surface, and the articulated receiver is rotational with respect to said base according to a rotating shaft perpendicular to the base, to allow rotation of the lever assembly in a plane parallel to the ground or surface.

BRIEF DESCRIPTION OF THE DRAWINGS

The details of the invention are shown in the attached drawings which do not seek to limit the scope of the invention.

DETAILED DESCRIPTION OF THE INVENTION

Figure 1:
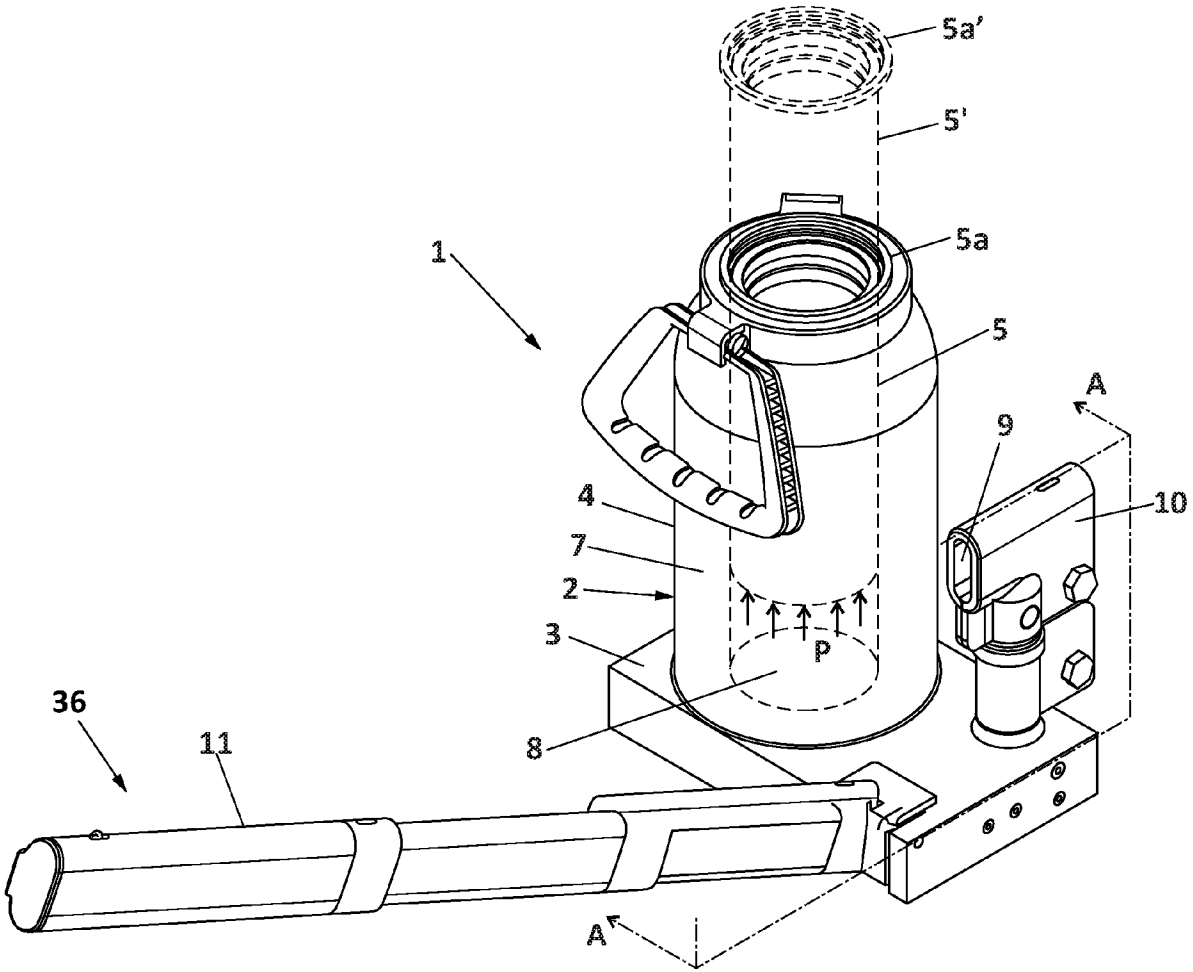
FIG. 1 shows a perspective view of a first embodiment of a bottle jack according to the invention.

FIG. 1 shows a first embodiment of a bottle jack according to the invention. The jack (1) comprises a main body (2) which, in the present embodiment, is formed by a base (3) intended for being supported on the ground or other applicable surface, and a bottle (4) which rises above the base (3). The jack (1) further comprises a shaft (5) expanding or contracting with respect to the main body (2), in this case with respect to the bottle (4), for lifting and lowering the load. The shaft (5) has an upper portion (5*a*) intended for contacting the load and pushing it. In FIG. 1, the shaft (5) is retracted inside the bottle (4). Nevertheless, to illustrate movement of the shaft (5), the shaft (5) and the upper portion (5*a*) are further depicted with dotted lines in an imaginary extended position (5', 5*a*') in which both have been expanded with respect to the bottle (4) due to pressure exerted on the shaft (5) by a hydraulic fluid contained in a hydraulically operated circuit (6). The hydraulically operated circuit, the exact configuration of which is not relevant for the present invention, can work, for example, by allowing passage of a hydraulic fluid from a first inner chamber (7) of the bottle (4), by acquiring pressure, to a second inner chamber (8) of the bottle (4), arranged below the shaft (5). In the jack (1) of the drawing, pressure would be provided to the hydraulic fluid by connecting an operating lever (11) to a housing (9) of a receiving element (10) articulated to the main body (2), in this case with respect to the base (3), and rotating said lever up and down repeatedly like a pump. The increasing pressure of the hydraulic fluid contained in the hydraulically operated circuit, and therefore in the second inner chamber (8) of the bottle (4), which pressure is schematically depicted in the drawing by means of arrows (P), would push the shaft (5) upwards and cause lifting of the shaft (5) and the load pushed by the upper portion (5*a*) of the shaft (5).

The jack (1) according to the invention has a novel unloading system to allow the controlled and secure lowering of the shaft (5) and the load supported by the shaft (5). FIG. 1 shows the jack (1) in a situation in which said unloading system is ready to be operated. More specifically, and according to an optional embodiment of the invention, the unloading system is ready to be operated by means of an operating lever (11). In said embodiment, furthermore, said operating lever (11) is precisely the operating lever for lifting the shaft (5) mentioned in the preceding paragraph. In other words, in this embodiment of the invention the jack (1) has a single operating lever (11) that can be disconnected from and connected to different points of the jack (1) and can be used both for controlled lifting and lowering of the shaft (5). To enable lifting as mentioned in the preceding paragraph, the operating lever (11) must be connected to the housing (9) of the receiving element (10). In contrast, to enable controlled lowering of the shaft (5) and load, in the present embodiment the operating lever (11) must be connected as illustrated in FIG. 1.

Figure 2:
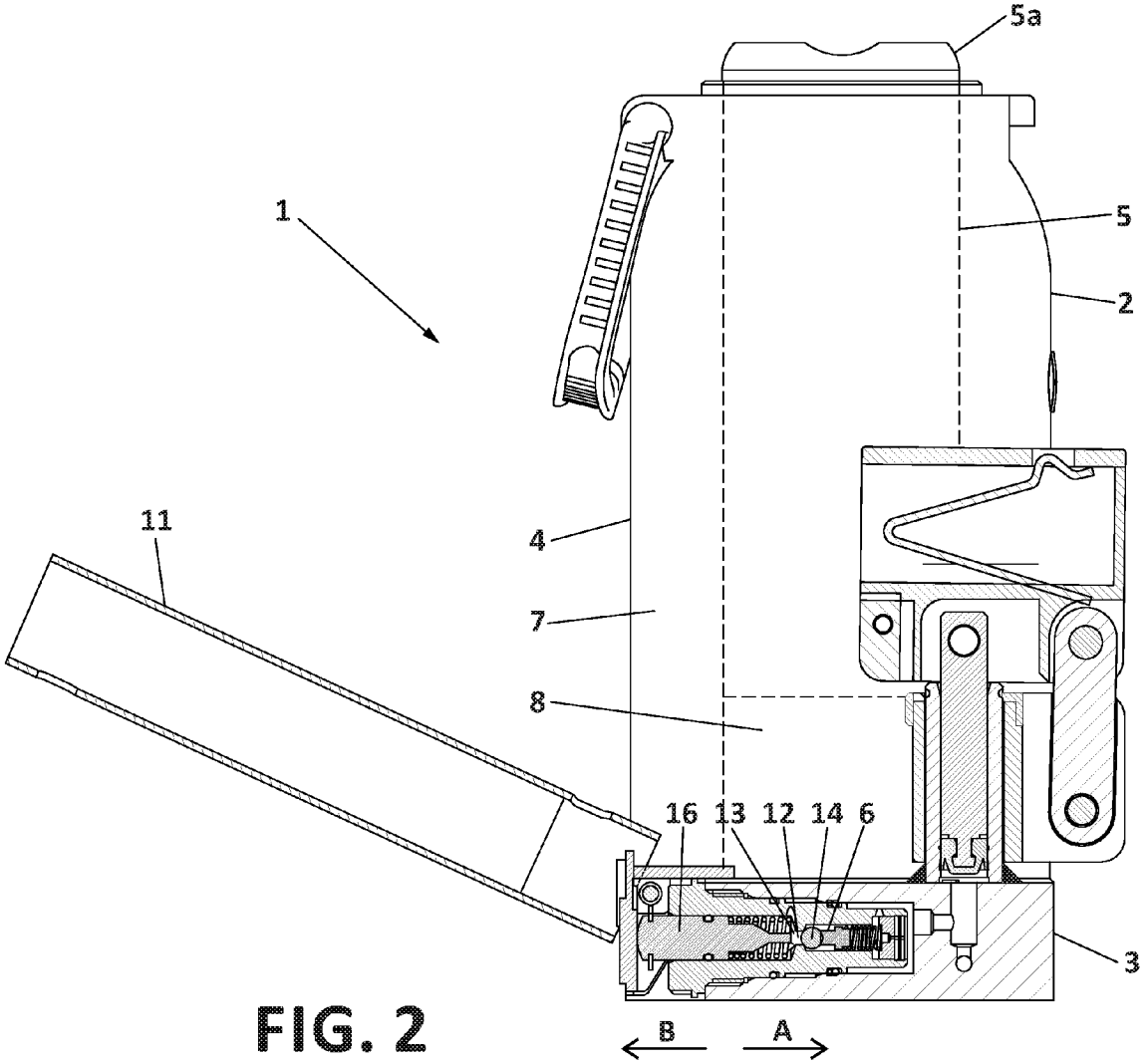
FIG. 2 shows a section view of the jack of the preceding figure according to section plane A-A indicated in FIG. 1.
Figure 3:
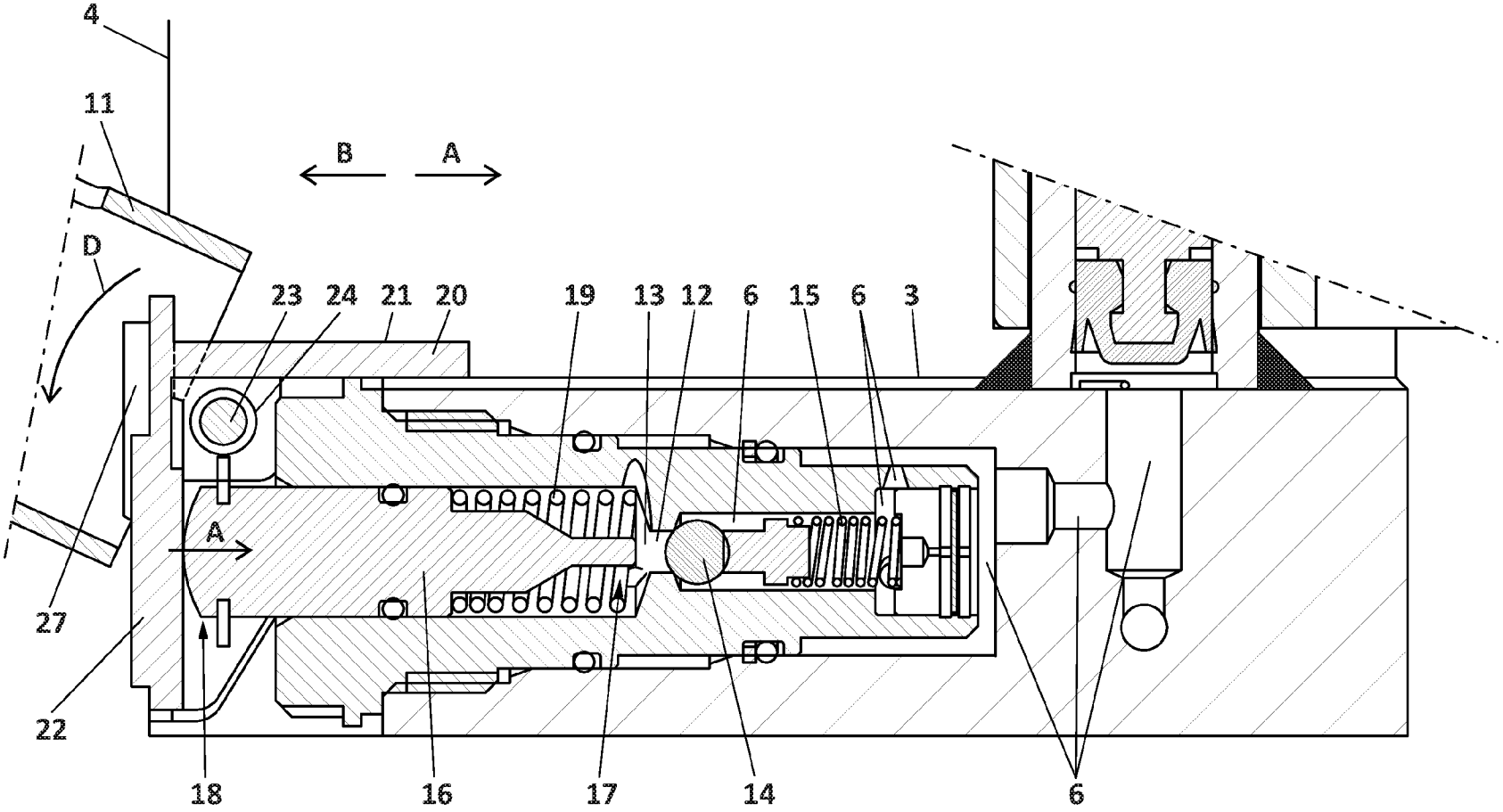
FIG. 3 shows an enlarged image of the lower area of FIG. 2 in which the unloading mechanism of the bottle jack is comprised.

FIG. 2 shows a section view of the jack (1) of the preceding figure according to section plane A-A indicated in FIG. 1. The unloading system of the present embodiment which allows activating controlled lowering of the shaft (5) and load is located inside the base (3) in the lower area of FIG. 2. FIG. 3 shows an enlarged view of said lower area of FIG. 2. As can particularly be seen in FIG. 3, the jack (1) comprises the mentioned hydraulically operated circuit (6) containing hydraulic fluid at a pressure that can be increased to lift the shaft (5). According to the invention, the jack (1) comprises a passage space (12) for fluid, where said passage space (12) communicates the hydraulically operated circuit (6) with an unloading circuit (13). The unloading circuit (13) is an additional fluid circuit the function of which is to receive and channel the hydraulic fluid leaving the hydraulically operated circuit (6) in a controlled manner, allowing subsequent lowering of the shaft (5); for example, the hydraulic unloading circuit (13) can connect the passage space (12) with the first inner chamber (7) of the bottle (4) to return the fluid to said first inner chamber (7). The jack (1) further comprises a closure element (14) located in the hydraulically operated circuit (6) and elastically pushed towards the passage space (12) to close said passage space (12) and prevent the controlled outlet of hydraulic fluid through the passage space (12). In the depicted embodiment, the closure element (14) is a ball and it is elastically pushed towards the passage space (12) by a spring (15).

Additionally, the jack (1) comprises a ram assembly (16) provided with an inner end (17) and an outer end (18). The inner end (17) is located inside the unloading circuit (13), whereas the outer end (18) is located outside the unloading circuit (13). Preferably, the user can directly or indirectly operate the outer end (18) from outside the jack (1) to cause unloading of the jack (1). The ram assembly (16) is movable with respect to the passage space (12) in a longitudinal forward movement direction (A) towards the passage space (12) and in a longitudinal backward movement direction (B) opposite the longitudinal forward movement direction (A). The inner end (17) of the ram assembly (16) has the function of pushing the closure element (14) and separating said closure element (14) from the passage space (12) when the user has directly or indirectly pushed the outer end (18) with enough force so as to move the ram assembly (16) a sufficient distance in the longitudinal forward movement direction (A).

In order to provide a safety mechanism that stops lowering of the shaft (5) in the event that the user does not perform any operation, the ram assembly (16) is elastically pushed in the longitudinal backward movement direction (B) by means of a spring (19), for example, as depicted in the drawings. The force with which the ram assembly (16) is elastically pushed in the longitudinal backward movement direction (B) is greater than the force with which the closure element (14) is elastically pushed against the passage space (12). This ratio of forces with which the ram assembly (16) and the closure element (14) are elastically pushed, in this case by means of respective springs (19, 15), allows this mechanism to automatically stop the unloading even if the pressure of the fluid contained in the hydraulically operated circuit (6) is very low.

In the present embodiment, the user can operate the outer end (18) from outside the main body (2) in the longitudinal forward movement direction (A), in this case indirectly. The term "indirect/indirectly" is understood as the operation being performed by means of intermediate parts between the user and the outer end (18). For example, in the depicted embodiment the jack (1) comprises the mentioned operating lever (11) for pushing the outer element (18) in the longitudinal forward movement direction (A), said operating lever (11) being an intermediate part between the user and the outer end (18). Furthermore, the depicted embodiment comprises an additional intermediate part, which is an L-shaped part (20) arranged between the operating lever (11) and the outer end (18). The L-shaped part (20) is arranged in an inverted manner against the base (3) of the main body (2) and comprises an upper segment (21) and a side segment (22). The L-shaped part (20) is capable of rotating with respect to the base (3) according to a rotating shaft (23). The rotating shaft (23) is provided in this case by a pin (24) articulating the L-shaped part (20) to the base (3). The side segment (22) pushes the outer end (18) of the ram assembly (16) when the L-shaped part (20) is rotated towards the inner end (18). Therefore, when the user rotates the operating lever (11) downwards as indicated by the arrow (D), the lower end of the operating lever (11) pushes the side segment (22) of the L-shaped part (20) and causes rotation of the L-shaped part (20) with respect to the rotating shaft (23); as a result, the side segment (22) of the L-shaped part (20) pushes the outer end (18) of the ram assembly (16) in a direction having a component in the longitudinal forward movement direction (A).

In the depicted embodiment, the operating lever (11) can be assembled on the L-shaped part (20) by means of non-rotational coupling of a hook-shaped projection (25) of the lower end of the operating lever (11) with a corresponding protuberance (26) of the L-shaped part (20). This is a simple and effective way of making the operating lever (11) and the L-shaped part (20) rotatably integral with one another in a disconnectable manner.

Figure 4:
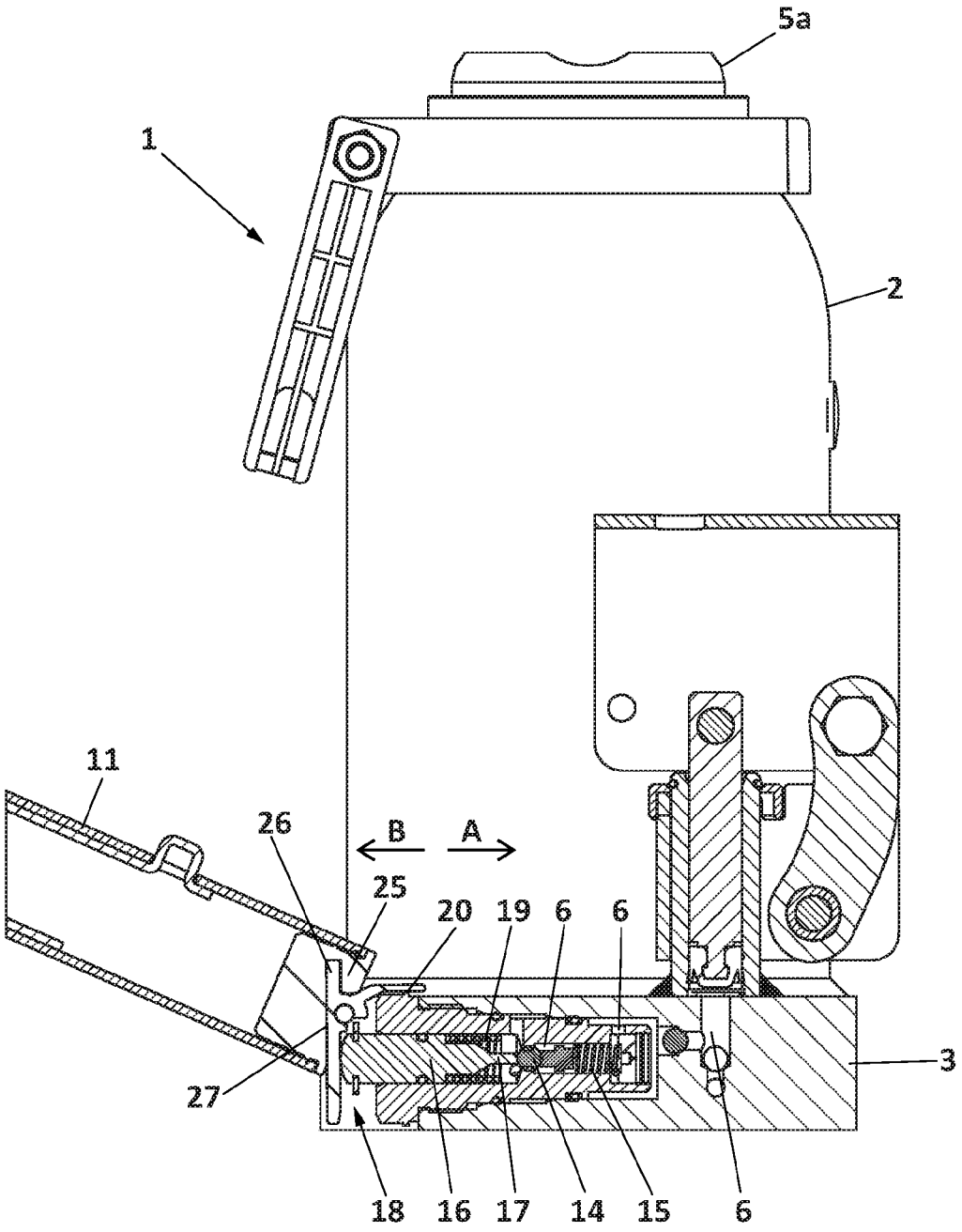
FIG. 4 shows a section view of the jack of FIG. 1 according to section plane A-A indicated in said figure. The unloading mechanism of the bottle jack in which the operating lever is completely assembled on the base thereof is also shown in detail.

FIG. 4 shows the assembly between the operating lever (11) and the L-shaped part (20) according to a preferred embodiment. The operating lever (11) preferably comprises a notch (27) at one end defining a hook (25), and the L-shaped part (20) comprises a protuberance (26) configured for being coupled in the notch (27) and retained by the hook (25). This configuration of the operating lever (11) and of the L-shaped part (20) allows anchoring the operating lever (11) to the jack (1) and operating the ram assembly (6). As shown in FIG. 4, the assembly between the operating lever (11) and the L-shaped part (20) causes movement in the inner end (17) of the ram assembly (16) such that said inner end (17) is in contact with the closure element (14).

FIG. 4 shows the configuration and arrangement of the elements after assembling the operating lever (11) with the L-shaped part (20). Once assembled, the user would operate the outer end (18) of the ram assembly (16) through the operating lever (11), allowing controlled lowering of the shaft (5).

Figure 5:
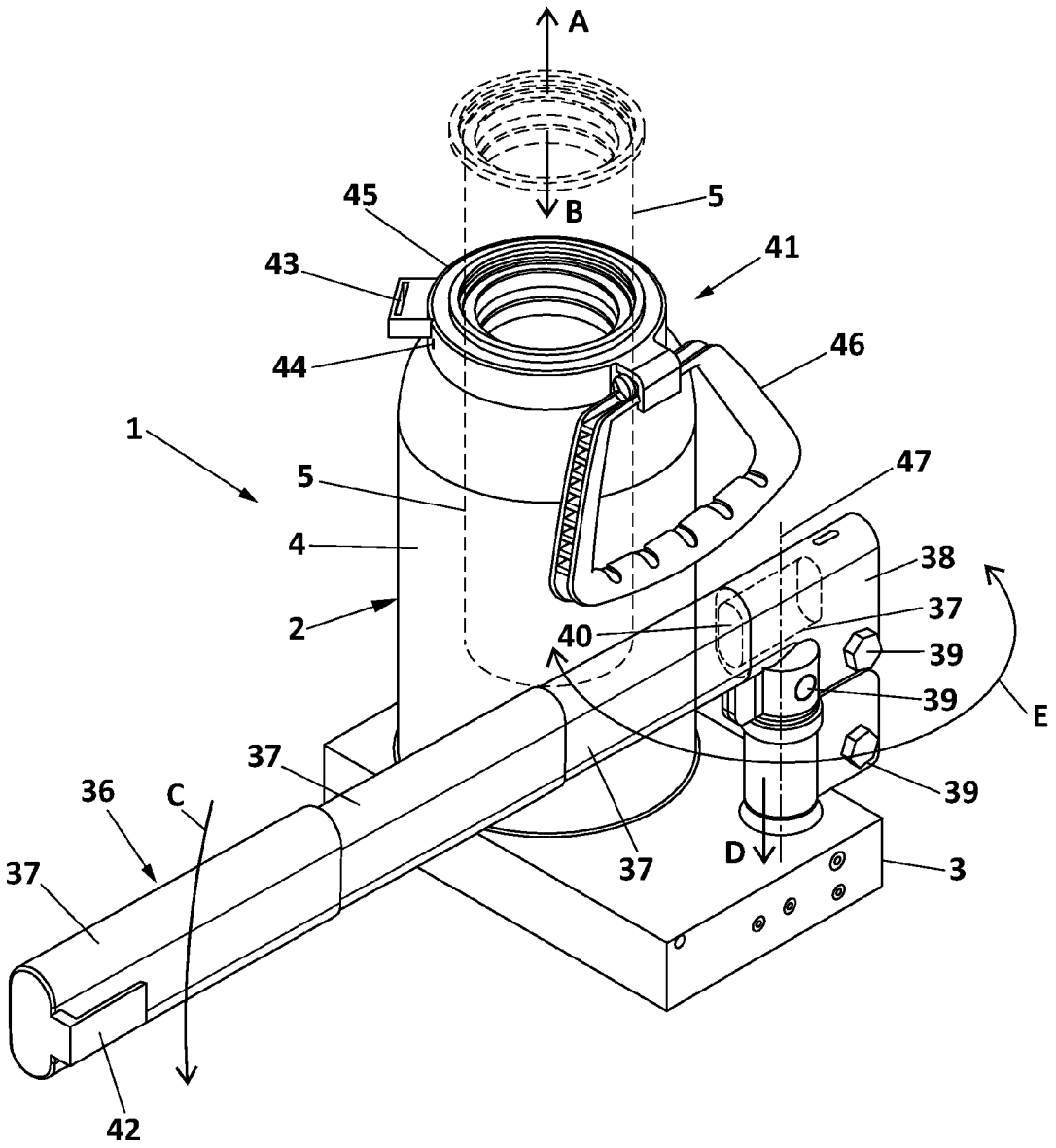
FIG. 5 shows a perspective view of an embodiment of the bottle jack according to the invention, depicted in a situation in which it is ready to be used for lifting a load.

FIG. 5 shows a perspective view of another embodiment of a bottle jack according to the invention. The jack (1) comprises a main body (2) provided with a base (3) and a bottle (4). The base (3) allows the jack (1) to be supported as a single unit on the ground or a surface. The jack (1) further comprises a shaft (5) capable of being moved with respect to the main body (2) in a direction of expansion (A) and in a direction of compression (B) for lifting and lowering the load, respectively. The bottle (4) and the shaft (5) are therefore a hydraulic piston, where movement of the shaft (5) is caused by a hydraulic system comprising an inner operating circuit through which a hydraulic fluid circulates. The jack (1) further comprises a lever assembly (36) to allow the user to operate the hydraulic system, i.e., to cause an increase in hydraulic fluid pressure which ultimately lifts the shaft (5). To that end, the lever assembly (36) can be lowered, such that when the user applies rotational pumping movements on the lever assembly (5) as indicated by the arrow (e), the hydraulically operated system converts the mechanical energy acquired by the lever assembly (36) into an increase in hydraulic fluid pressure. Said increase in pressure causes movement of the shaft (5) in the direction of expansion (A).

According to the invention, the lever assembly (36) is telescopic, i.e., the lever assembly (36) is formed by various portions (37) fitting successively into one another, one inside the next, like a manual telescope. The total length of the lever assembly (36) is variable. Therefore, when the user wants to store the jack (1), they can stow away the lever assembly (36), causing the portions (37) to be housed one inside another to the greatest extent possible, reducing the length of the lever assembly (36) to a minimum. As a result, the total dimensions of the jack (1) can be reduced when the jack (1) is to be stored, facilitating storage thereof.

The lever assembly (36) is connected to an articulated receiver (38), which is generally any mechanism that provides the lever assembly (36) with a rotating connection to the main body (2) to enable pumping or rotating in a vertical plane as indicated by the arrow (C). In the depicted embodiment, the articulated receiver (38) is a mechanism comprising three articulated connections (39); said three articulated connections (39) define an articulated triangle transforming rotational movement of the lever assembly (36) in a vertical plane as indicated by the arrow (C) into movement of hydraulic fluid in a downward vertical direction within the articulated receiver (38) as indicated by the arrow (O). The hydraulic fluid located inside the articulated receiver (38) acquires pressure and is pushed towards the base (3) and the bottle (4) in order to push the shaft (5). According to the invention, the lever assembly (36) can be disassembled from the articulated receiver (38). In the depicted embodiment, the end portion (37) of the lever assembly (36) is detachably connected in a housing (40) of the articulated receiver (38).

Optionally, the lever assembly (36) comprises at least one fixing element for fixing the lever assembly (36) to an area of the main body (2) other than the articulated receiver (38), once the lever assembly (36) is disconnected from the articulated receiver (38). This allows connecting the lever assembly (36) to the rest of the jack (1) once it is disconnected from the articulated receiver (38) and telescopically stowed away, the risk of the lever assembly (36) getting lost being reduced or eliminated.

In the embodiment depicted in the drawing, the shaft (5) is moved projecting from an upper area (41) of the bottle (4), and the fixing element serves to connect the lever assembly (36) precisely to said upper area (41). This allows the connection between the stowed lever assembly (36) and the rest of the jack (1) to be established in a higher portion and the lever assembly (36) to hang freely from said connection in a downward position, making it more difficult for the lever assembly (36) to be undesirably disconnected.

In the embodiment of FIG. 5, the fixing element comprises a hook-type element (42) and a receiving opening (43) suitable for receiving said hook-type element (42). In addition to being intuitive for the user, a hook-type fixing is an optimal solution for connecting the lever assembly (36) vertically to the bottle (4) and taking advantage of the action of gravitational force to maintain the connection or coupling of the lever assembly (36) hanging from the bottle (4).

In the particular case that is depicted, the hook-type element (42) is a flange comprised in the lever assembly (36) and the receiving opening (43) is a groove comprised in the upper area (41) of the bottle (4) and suitable for receiving the flange. This allows configuring a hard-to-break hook, since the shape of the flange can resemble the shape of the lever assembly (36), and furthermore the flange can be arranged substantially close to the portion (37) of the lever assembly (36) and therefore be protected by the rest of the lever assembly (36).

Figure 6:
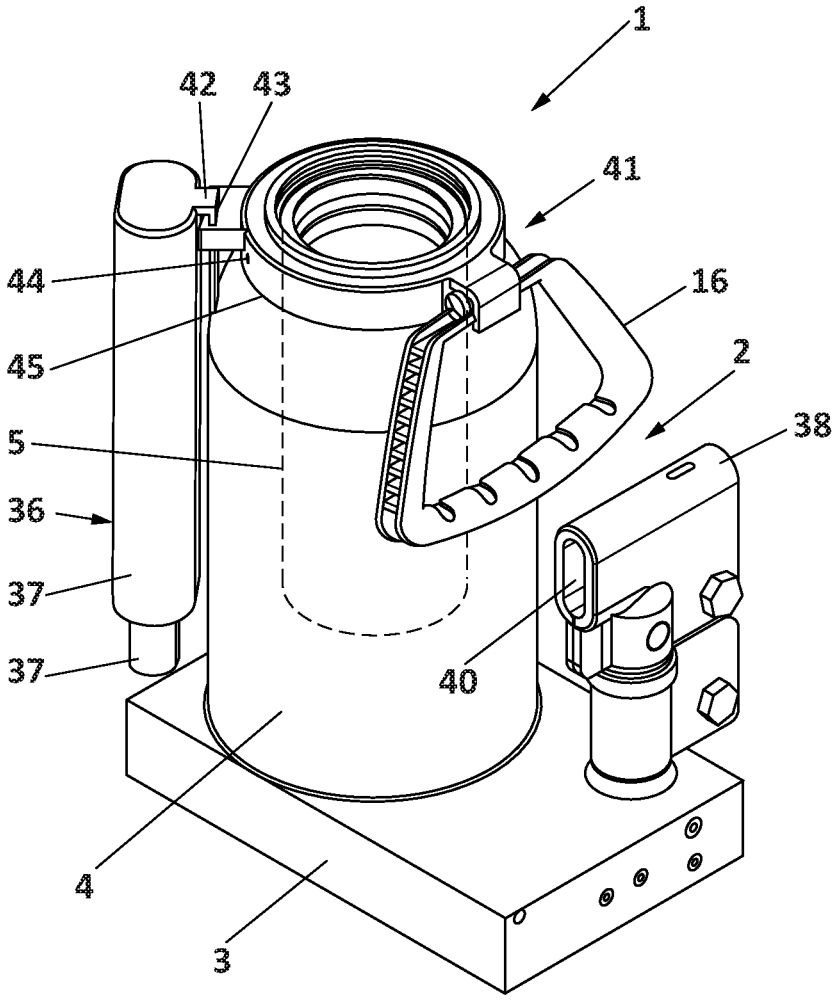
FIG. 6 shows the jack of the preceding figure, depicted in a situation in which it is ready to be stored.

FIG. 6 shows the jack (1) of FIG. 5 in a second situation in which the lever assembly (36) is disconnected from the articulated receiver (38), telescopically stowed away and hanging from the upper area (41) of the bottle (4). As can be seen, the jack (1) is ready to be stored as one unit without separate portions, and it is very simple for the operator to handle the jack (1) to attain this situation. The lever assembly (36) is usually kept hanging by the action of gravitational force, the probability of the lever assembly (36) being separated from the rest of the jack (1) and getting lost being reduced to a minimum.

Optionally, as shown in FIGS. 4 and 5 the upper area (41) of the jack (1) comprises a neck (44) with a ring (45) arranged around it. The ring (45) is rotational with respect to the neck (44). The fixing element, in this case the assembly formed by the hook-type element (42) and the receiving opening (43), connects the lever assembly (36) precisely with said ring (45). This allows the user to choose the area of the bottle (4) from which to hang the stowed lever assembly (36) should it be useful in specific situations (for example, if the lever assembly (36) is to be concealed behind the bottle (4) once the jack (1) is placed in a specific point for storage).

The ring (45) also optionally comprises a handle (46) to allow gripping by the user. This facilitates handling and transport of the jack (1) by the user, not only due to there being a handle (46) but also due to the fact that the rotational position of the handle (46) on the outer perimeter of the bottle (4) can change.

The articulated receiver (38) is also optionally rotational with respect to the base (3) of the main body (2) according to a rotating shaft (47) perpendicular to the base (3). As a result, the lever assembly (36) is capable of rotating in a plane parallel to the ground or surface on which the base (3) is supported, as indicated by the arrow (E). This allows the user to change the orientation of the lever assembly (36) with respect to the main body (2), and therefore operate the lever assembly (36) from a comfortable position at all times regardless of the placement of the main body (2).

The invention claimed is:

1. Bottle jack comprising a main body and a shaft expanding or contracting with respect to the main body for lifting and lowering a load, where the shaft expands due to pressure exerted by a hydraulic fluid contained in a hydraulically operated circuit that comprises:

a passage space communicating the hydraulically operated circuit with an unloading circuit through which the controlled outlet of hydraulic fluid from the hydraulically operated circuit and subsequent lowering of the shaft can occur;

a closure element located in the hydraulically operated circuit and elastically pushed towards the passage space to close said passage space and preventing the controlled outlet of hydraulic fluid through the passage space;

a ram assembly provided with an outer end, outside the unloading circuit, and an inner end, inside the unloading circuit, said ram assembly being movable with respect to the passage space in a longitudinal forward movement direction (A) towards the passage space and in a longitudinal backward movement direction (B) opposite the longitudinal forward movement direction (A), where the inner end of the ram assembly pushes the closure element and separates said closure element from the passage space when the outer end is pushed, moving the ram assembly a sufficient distance in the longitudinal forward movement direction (A); where the bottle jack is characterized in that:

the ram assembly is elastically pushed in the longitudinal backward movement direction (B) with a force greater than the force with which the closure element is elastically pushed against the passage space, and the user can operate the outer end from outside the main body in the longitudinal forward movement direction (A);

and in that the bottle jack further comprises:

an L-shaped part arranged in an inverted manner against a base of the main body, where said L-shaped part comprises an upper segment and a side segment and is capable of rotating with respect to said base according to a rotating shaft, where the side segment pushes the outer end of the ram assembly when the L-shaped part is rotated towards the inner end;

a lever assembly which can be lowered by a user to operate the hydraulically operated system, where said lever assembly is telescopic such that the total length of the lever assembly is variable;

an articulated receiver to which the lever assembly is connected, the articulated receiver providing the lever assembly with a rotating connection with respect to the main body, and wherein the lever assembly can be disassembled from the articulated receiver; and at least one fixing element for fixing the lever assembly, when it is disconnected from the articulated receiver, to an area of the main body other than the articulated receiver, wherein the fixing element fixes the lever assembly, when it is disconnected from the articulated receiver, to an upper area of the bottle through which the shaft projects, wherein the upper area of the bottle comprises a neck with a ring rotatably arranged around the neck, and wherein the fixing element connects the lever assembly, when it is disconnected from the articulated receiver, to the ring.

2. Bottle jack according to claim 1, wherein the closure element is a ball.

3. Bottle jack according to claim 1, wherein the closure element is elastically pushed towards the passage space by a spring.

4. Bottle jack according to claim 1, wherein the ram assembly is elastically pushed in the longitudinal backward movement direction (B) by a spring.

5. Bottle jack according to claim 1, wherein the lever assembly comprises an operating lever for pushing the outer end of the ram in the longitudinal forward movement direction (A).

6. Bottle jack according to claim 5, wherein the operating lever can also be assembled on a receiving element articulated to the main body to allow applying pressure on the hydraulic fluid contained in a hydraulically operated circuit and expansively operating the shaft.

7. Bottle jack according to claim 5, wherein the operating lever can be assembled on the L-shaped part such that rotation of the operating lever causes rotation of the L-shaped part with respect to the rotating shaft.

8. Bottle jack according to claim 7, wherein the operating lever comprises a notch at one end defining a hook, and in that the L-shaped part comprises a protuberance configured to couple in the notch and retained by the hook.

9. The bottle jack according to claim 1, wherein the fixing element comprises a hook-type element and a receiving opening suitable for receiving said hook-type element.

10. The bottle jack according to claim 1, wherein the ring comprises a handle to allow gripping by the user.

11. The bottle jack according to claim 1, wherein the main body comprises a base for supporting the jack on the ground or a surface, and in that the articulated receiver is rotational with respect to said base according to a rotating shaft perpendicular to the base, to allow rotation of the lever assembly in a plane parallel to the ground or surface.

* * * * *